US008528524B2

(12) United States Patent
Hofmann et al.

(10) Patent No.: US 8,528,524 B2
(45) Date of Patent: Sep. 10, 2013

(54) FUEL INJECTION VALVE FOR ARRANGEMENT IN A COMBUSTION CHAMBER OF AN INTERNAL COMBUSTION ENGINE

(75) Inventors: Thomas Hofmann, Obertraubling (DE); Michael Härtel, Zwickau (DE); Uwe Leuteritz, Regensburg (DE); Ferdinand Löbbering, Alteglofsheim (DE)

(73) Assignee: Continental Automotive GmbH, Hannover (DE)

( * ) Notice: Subject to any disclaimer, the term of this patent is extended or adjusted under 35 U.S.C. 154(b) by 281 days.

(21) Appl. No.: 13/056,474

(22) PCT Filed: Jun. 18, 2009

(86) PCT No.: PCT/EP2009/057590

§ 371 (c)(1),
(2), (4) Date: Feb. 7, 2011

(87) PCT Pub. No.: WO2010/015454

PCT Pub. Date: Feb. 11, 2010

(65) Prior Publication Data

US 2011/0132329 A1 Jun. 9, 2011

(30) Foreign Application Priority Data

Aug. 5, 2008 (DE) ..... 10 2008 036 413

(51) Int. Cl.
*F02M 61/14* (2006.01)
*F02M 61/18* (2006.01)

(52) U.S. Cl.
USPC ..... 123/470

(58) Field of Classification Search
USPC ..... 123/470, 193.5, 467; 239/533.11, 239/533.12, 533.2, 600; 277/313, 315, 594, 277/596, 607, 608
See application file for complete search history.

(56) References Cited

U.S. PATENT DOCUMENTS 3,695,235 A 10/1972 Anderson ..... 123/32 R
5,330,100 A * 7/1994 Malinowski ..... 239/102.2

(Continued)

FOREIGN PATENT DOCUMENTS

CN 1394256 A 1/2003
CN 1644915 A 7/2005

(Continued)

OTHER PUBLICATIONS

Chinese Office Action, China Patent Application No. 200980130864.2, 23 pages, Aug. 31, 2012.

(Continued)

*Primary Examiner* — Mahmoud Gimie
(74) *Attorney, Agent, or Firm* — King & Spalding L.L.P.

(57) ABSTRACT

A fuel injection valve for arrangement in a combustion chamber (40) of an internal combustion engine has a nozzle support with a nozzle body (30) disposed thereon in fixed fashion by way of a nozzle clamping nut (20), the nozzle body designed to protrude into the combustion chamber (40) and being provided for holding a nozzle needle, and at least one annular combustion chamber sealing element (50) with an upper support surface (60) facing the nozzle clamping nut (20) and a lower support surface (70) facing the combustion chamber (40), the lower surface surrounding the nozzle body (30) and being provided for sealing the nozzle support off from the combustion chamber (40). At least one additional sealing element (80) is provided for sealing the nozzle body (30) in the area of the nozzle clamping nut (20).

18 Claims, 4 Drawing Sheets

(56) References Cited

U.S. PATENT DOCUMENTS

| | | | | |
|---|---|---|---|---|
| 6,811,102 | B2 * | 11/2004 | Krause et al. | 239/533.2 |
| 7,261,246 | B2 | 8/2007 | Krause et al. | 239/88 |
| 7,832,376 | B2 | 11/2010 | Mueller et al. | 123/470 |
| 2002/0152995 | A1 | 10/2002 | Kato | 123/470 |
| 2005/0016501 | A1 | 1/2005 | Krause et al. | 123/470 |

FOREIGN PATENT DOCUMENTS

| | | | |
|---|---|---|---|
| DE | 19807819 | C1 * | 5/1999 |
| DE | 10102192 | A1 | 11/2002 |
| DE | 102004049277 | A1 | 4/2006 |
| DE | 102005053112 | A1 * | 5/2007 |
| GB | 1262164 | | 2/1972 |

OTHER PUBLICATIONS

International PCT Search Report and Written Opinion, PCT/EP2009/057590, 14 pages, Oct. 21, 2009.

* cited by examiner

FUEL INJECTION VALVE FOR ARRANGEMENT IN A COMBUSTION CHAMBER OF AN INTERNAL COMBUSTION ENGINE

CROSS-REFERENCE TO RELATED APPLICATIONS

This application is a U.S. National Stage Application of International Application No. PCT/EP2009/057590 filed Jun. 18, 2009, which designates the United States of America, and claims priority to German Application No. 10 2008 036 413.4 filed Aug. 5, 2008, the contents of which are hereby incorporated by reference in their entirety.

TECHNICAL FIELD

The invention relates to a fuel injection valve for mounting to a combustion chamber of an internal combustion engine, comprising a nozzle support with a nozzle body disposed thereon in a fixed manner via a nozzle clamping nut, said nozzle body designed to protrude into the combustion chamber and being provided for holding a nozzle needle, and at least one annular sealing element comprising an upper support surface facing the nozzle clamping nut and a lower support surface facing the combustion chamber, said sealing element surrounding the nozzle body and being provided for sealing the nozzle support from the combustion chamber.

BACKGROUND

A nozzle clamping nut holds the two main components of the fuel injector—an injection nozzle and a valve body—tightly together. When the fuel injector is mounted to the cylinder head, the injection nozzle protrudes into a combustion chamber of a motor vehicle engine, the valve body disposed thereabove actuating the injection nozzle. It is necessary here to seal off the fuel injector from the combustion chamber at the cylinder head. This is accomplished by appropriate design of the nozzle clamping nut acting in conjunction with a corresponding device, a seal seat, in the cylinder head.

Such a sealing arrangement must meet exacting requirements. On the one hand, the sealing arrangement is exposed to high thermal loads (−40° C. for cold starting in winter, to over +150° C.) during operating conditions and, on the other hand, the sealing device is subject to high mechanical stress, particularly vibration loads. In addition, the sealing arrangement must ensure a durable, long-lasting seal between fuel injector and cylinder head.

In the prior art there is embodied for this purpose, e.g. on the nozzle clamping nut, a horizontal rim which is seated on a likewise horizontal rim provided in the injector bore, and the nozzle clamping nut or rather the fuel injector is pressed with high static force against the cylinder head. By providing a large areal overlap of the two rims, it is intended to create a durable fluid-tight joint.

The injector is generally sealed off from the combustion chamber by a metal sealing washer. This sealing is necessary because of the hot exhaust gases and the pressure loss in the cylinder. Due to the high combustion temperatures and high cylinder pressures, sealing is only possible using a metal sealing washer, so that no combustion gases can flow directly past the injector and into the environment.

In DE 101 02192 A1, a nozzle clamping nut has, on a free end, a truncated cone shaped region which can be inserted in a corresponding truncated cone shaped injector bore section. In the preassembled state, i.e. when the fuel injector with nozzle clamping nut is inserted in the truncated cone shaped injector bore, there is a circumferential angular difference of 2° to max. 5° between the truncated cone on the nozzle clamping nut and the truncated cone bore in the cylinder head. This ensures that the fuel injector is centered in the injector bore, the fuel injector then being pressed with high static force into the bore and a common sealing surface being formed between the truncated cone of the nozzle clamping nut and conical arc in the cylinder head.

Mixture and the hot combustion gases flow as far as the sealing locations of nozzle clamping nut and nozzle body, and also the seal between injector and cylinder head. In this gap there is now a build-up of unburned mixture and exhaust gases, e.g. $H_2O$ and S. After the engine is turned off, condensation of electrolyte (water) may now occur in the cool-down phase. The electrolyte promotes ion exchange and therefore corrosion.

In the prior art it is also known to screw the nozzle tightly to the nozzle clamping nut without any additional sealing. Also known is protecting the nozzle body from heat by coating it and installing sleeves as heat sinks. However, new combustion methods appear to cause corrosion precisely in this area, so that direct sealing against corrosive substances from combustion gases is absolutely necessary in this region.

SUMMARY

According to various embodiment, a fuel injection valve for mounting to a combustion chamber of an internal combustion engine can be provided, said valve ensuring improved sealing of the nozzle shaft in the region of the nozzle clamping nut with respect to the combustion chamber.

According to an embodiment, a fuel injection valve for arrangement in a combustion chamber of an internal combustion engine, may comprise a nozzle support with a nozzle body disposed thereon in a fixed manner via a nozzle clamping nut, said nozzle body designed to protrude into the combustion chamber and being provided for holding a nozzle needle, and at least one annular combustion chamber sealing element comprising an upper support surface facing the nozzle clamping nut and a lower support surface facing the combustion chamber, said lower surface surrounding the nozzle body and serving to seal the nozzle support from the combustion chamber, characterized in that at least one additional sealing element is provided for sealing the nozzle body in the area of the nozzle clamping nut.

According to a further embodiment, the sealing element can be disposed on the nozzle clamping nut or/and the combustion chamber seal. According to a further embodiment, the sealing element can be embodied as a separate element. According to a further embodiment, the sealing element can be made from very soft metals, heat resistant polymers or other fuel resistant materials. According to a further embodiment, the sealing element can be embodied by vulcanizing a seal onto the nozzle clamping nut. According to a further embodiment, the sealing element can be embodied by vulcanizing a seal onto the combustion chamber seal. According to a further embodiment, a heat resistant potting compound can be provided in a gap region between nozzle clamping nut and nozzle body. According to a further embodiment, the sealing element can be formed by part of the nozzle clamping nut. According to a further embodiment, the sealing element can be formed by part of the combustion chamber seal.

BRIEF DESCRIPTION OF THE DRAWINGS

The invention will now be explained in greater detail on the basis of exemplary embodiments with reference to the accompanying drawings in which.

DETAILED DESCRIPTION

Figure 1:
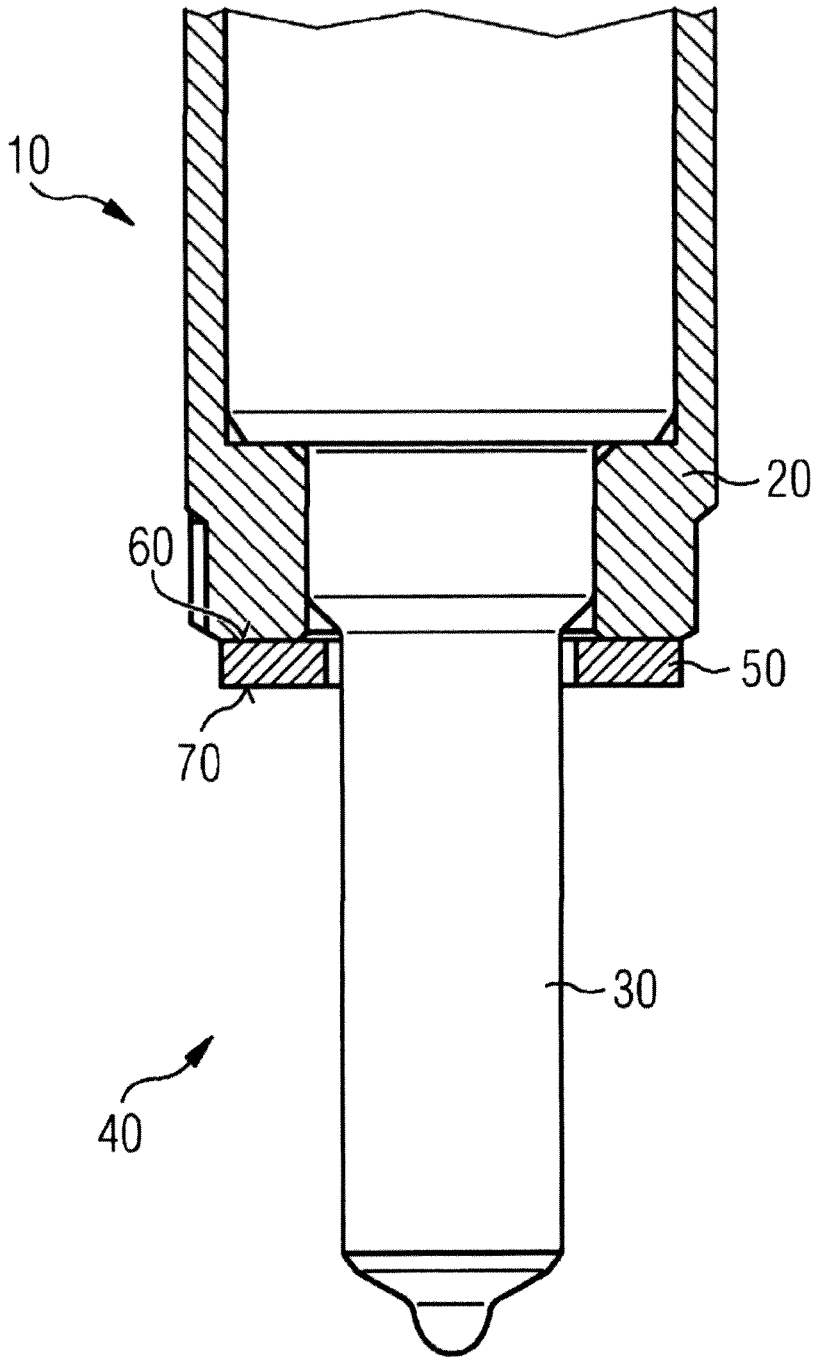
FIG 1 (PRIOR ART)
FIG. 1: shows a nozzle body locked in place via a nozzle clamping nut, as known from the prior art.

FIG. 1 shows a longitudinal section through part of a fuel injection valve 10 with a nozzle clamping nut 20 which tightly grips a nozzle body 30. Schematically indicated at 40 is a combustion chamber into which the nozzle body 30 partially protrudes. Disposed at the interface of the nozzle clamping nut 20, nozzle body 30 and combustion chamber 40 is a combustion chamber sealing element 50. The combustion chamber sealing element 50 surrounds the part of the nozzle body 30 extending beyond the nozzle clamping nut 20. The nozzle body 30 has a circular or more specifically annular cross section in the longitudinal direction, i.e. in the injection direction. The combustion chamber sealing element 50 likewise has a thereto corresponding annular cross section in the longitudinal direction. The external diameter of the nozzle body cross section approximately corresponds to the internal diameter of the opening of the combustion chamber sealing element 50 (annular opening). The combustion chamber sealing element 50 has two end faces or bearing surfaces, an upper bearing surface 60 facing the nozzle clamping nut 20 and a lower bearing surface 70 facing the combustion chamber 40.

Figure 2:
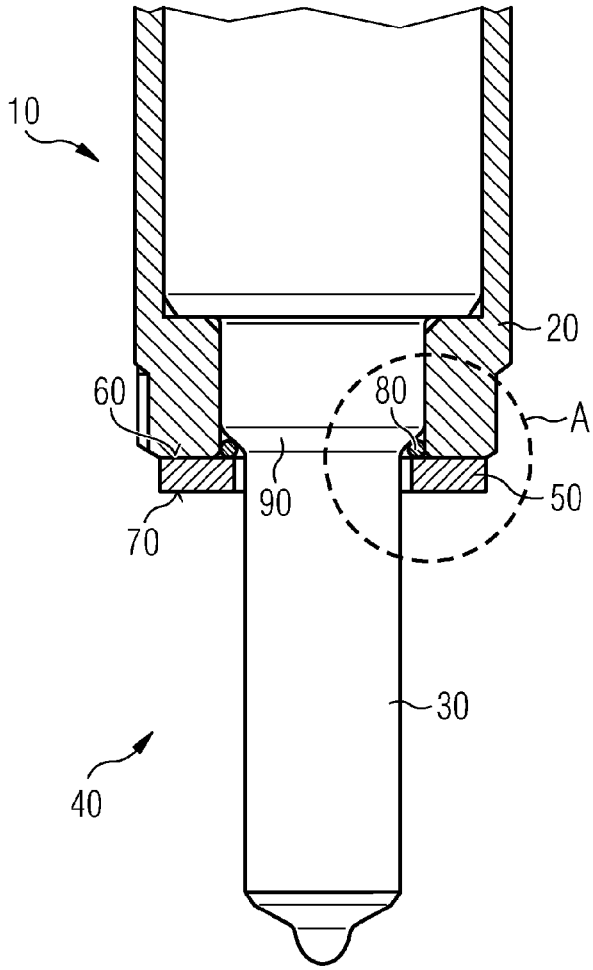
FIG. 2: shows the arrangement according to FIG. 1 with a first additional separate seal according to various embodiments.
Figure 2A:
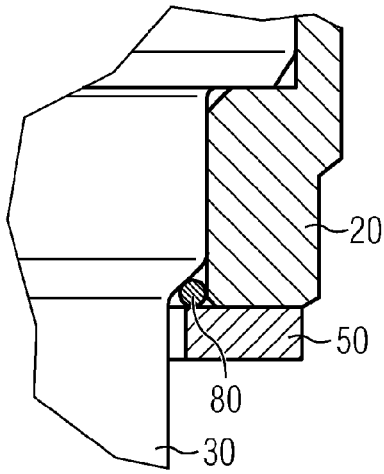
FIG. 2*a*: shows a detail A of FIG. 2.

FIG. 2 shows a longitudinal section through a corresponding detail according to FIG. 1, wherein an additional sealing element 80 is provided. Said sealing element grips around the nozzle body 30 in the region of a shoulder 90 of the nozzle body 30 in the contact area of the nozzle clamping nut 20 and combustion chamber sealing element 50. The sealing element 80 can be embodied as a separate annular element consisting of very soft metals, heat resistant polymers or other fuel resistant materials. The internal diameter of said annular sealing element 50 corresponds approximately to the external diameter of the nozzle body 30, so that it can be mounted thereon from the combustion chamber end of the nozzle body. FIG. 2A shows the enlarged area A from FIG. 2. It should be noted that, in the assembled state of the fuel injection valve, the sealing element 80 bears against the nozzle body 30, the nozzle clamping nut 20 and the combustion chamber sealing element 50.

Figure 3:
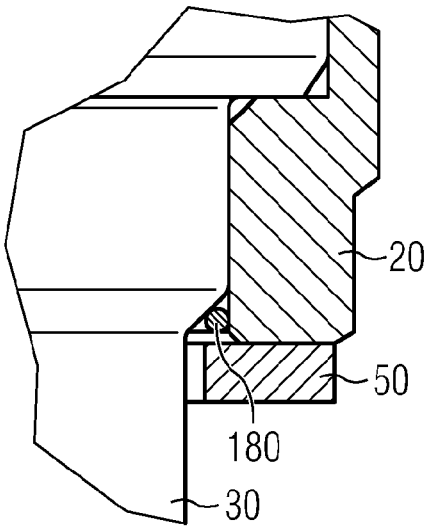
FIG. 3: shows a detail corresponding to FIG. 2A with a second variant of the additional separate seal according to various embodiments.

FIG. 3 shows the same detail as FIG. 2*a*, wherein the sealing element 180 is here formed by vulcanizing a sealing area onto the nozzle clamping nut 20, the sealing element 180 being vulcanized-on prior to mounting of the combustion chamber sealing element 50. As can be seen from FIG. 3, the sealing element 180 is only in contact with the nozzle body 30 and the nozzle clamping nut 20. However, contact also with the combustion chamber sealing element 50 in the completely assembled state is not ruled out here.

Figure 4:
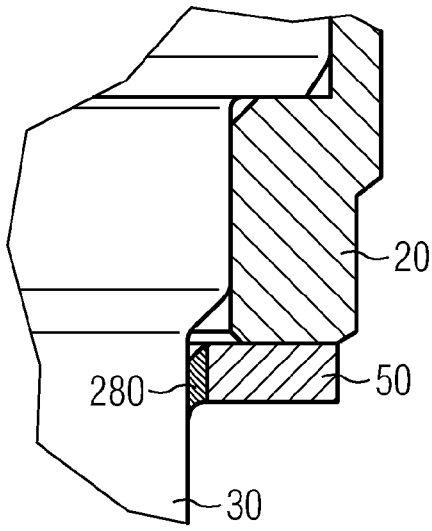
FIG. 4: shows a detail corresponding to FIG. 2*a* with a third variant of the additional separate seal according to various embodiments.

FIG. 4 likewise shows a detail according to that of FIG. 2A. In this exemplary embodiment also, a sealing element 280 is formed by vulcanization. In contrast to FIG. 3, however, the sealing element 280 is vulcanized onto the combustion chamber sealing element 50, namely in the region between the outer circumference of the nozzle body and that in the inner circumference of the combustion chamber sealing element 50.

Figure 5:
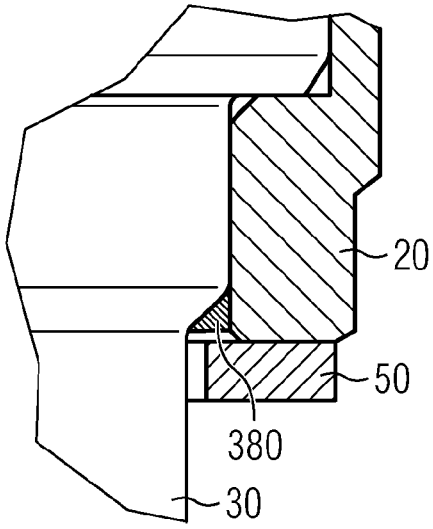
FIG. 5: shows a detail corresponding to FIG. 2*a* with a fourth variant of the additional separate seal according to various embodiments.

FIG. 5 also shows the fuel injection valve detail corresponding to FIG. 2A. In this exemplary embodiment, the gap formed by the shoulder of the nozzle body 30, the nozzle clamping nut 20 and the combustion chamber sealing element 50 is filled with a heat resistant potting compound as a sealing element 380. Said potting compound is introduced after the nozzle clamping nut 20 has been screwed together with the nozzle body 30. Consequently, the sealing element 380 abuts the nozzle body 30 and the nozzle clamping nut 20.

Figure 6:
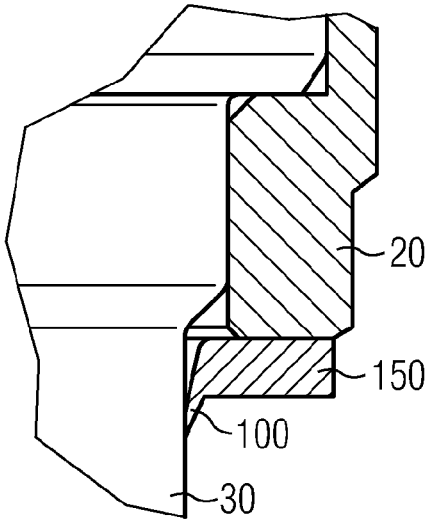
FIGS. 6-8: each show a detail corresponding to FIG. 2A with in each case different geometric modifications of the combustion chamber seal.
Figure 8:
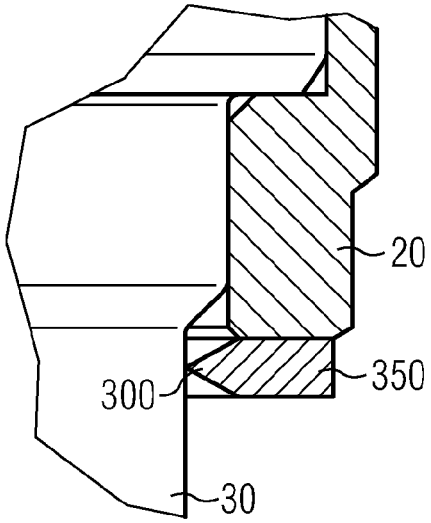
Figure 7:
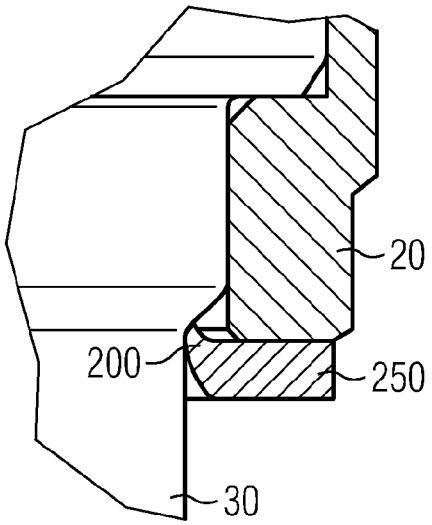

FIGS. 6 to 8 show examples in which, by modifying the geometry of the combustion chamber sealing element 150, 250, 350, another additional seal is formed is order to seal against deposits due to unburned mixture and exhaust gases in the gap between nozzle clamping nut 20 and nozzle body 30. FIG. 6 shows an annular combustion chamber sealing element 150 which has, in the region of its internal diameter, radially inward, a tongue 100 formed in longitudinal section in the axial direction toward the combustion chamber. In the cross section of the combustion chamber sealing element 150, said tongue 100 tapers radially inwardly downward (in the direction of the combustion chamber 40) to the extent that a sealing contact with the outer circumferential surface of the nozzle body 30 is established.

FIG. 7 likewise shows an annular combustion chamber sealing element 250 with a tongue 200 oriented away from the combustion chamber 40 in the axial direction of the fuel injection valve. Like the tongue 100 in FIG. 6, the tongue 200 tapers in the cross section of the combustion chamber sealing element 250 and forms a sealing contact with the nozzle body 30 in the region of the shoulder 90 of the nozzle body 30.

FIG. 8 also shows an annular combustion chamber sealing element 350. In the region of its radially internal diameter, this combustion chamber sealing element 350 narrows uniformly radially inward and tapers in cross section to the external diameter of the nozzle body, forming a sealing contact therewith. In this example, the seal is therefore established via a cross-sectionally rectangular tongue 300 of the combustion chamber sealing element 350.

Figure 9:
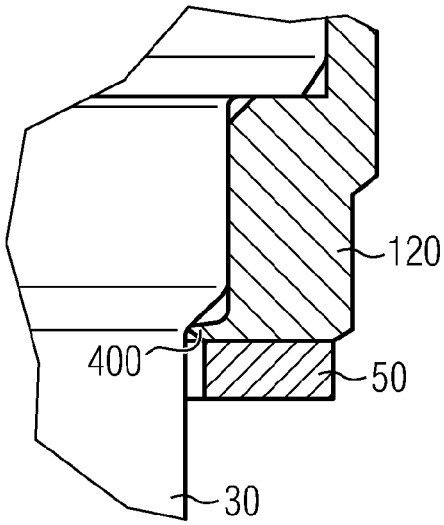
FIG. 9: shows a detail corresponding to FIG. 2A with a geometric modification of the nozzle clamping nut.

FIG. 9 shows a sealing element 400 which is formed by a tongue extending radially inward on the nozzle clamping nut 120. For this purpose the nozzle clamping nut 120 has, on its region adjacent to the combustion chamber sealing element 50, a projection 400 which projects radially inward to the extent that it comes into sealing contact with the nozzle body 30 in the region of the shoulder 90. In this case the tongue 400 is shown as tapered, but can also have a cross-sectionally different shape therefrom.

The invention is not limited to the embodiments described above. Indeed, deviations therefrom are also conceivable without departing from the scope of protection sought in the subsequent claims.

What is claimed is:

1. A fuel injection valve for a combustion chamber of an internal combustion engine, comprising:

a nozzle support with a nozzle body disposed thereon in a fixed manner via a nozzle clamping nut, said nozzle body protruding into the combustion chamber and holding a nozzle needle, and at least one annular combustion chamber sealing element comprising an upper support surface facing the nozzle clamping nut and a lower support surface facing the combustion chamber, said lower surface surrounding the nozzle body and serving to seal the nozzle support from the combustion chamber, and at least one additional sealing element for sealing the nozzle body held in contact with the nozzle clamping nut by the upper surface of the at least one annular combustion chamber sealing element.

2. The fuel injection valve according to claim 1, wherein the sealing element is disposed on at least one of the nozzle clamping nut and the combustion chamber seal.

3. The fuel injection valve according to claim 1, wherein the sealing element is embodied as a separate element.

4. The fuel injection valve according to claim 1, wherein the sealing element is made from very soft metals, heat resistant polymers or other fuel resistant materials.

5. The fuel injection valve according to claim 1, wherein the sealing element is embodied by vulcanizing a seal onto the nozzle clamping nut.

6. The fuel injection valve according to claim 1, wherein the sealing element is embodied by vulcanizing a seal onto the combustion chamber seal.

7. The fuel injection valve according to claim 1, wherein a heat resistant potting compound is provided in a gap region between nozzle clamping nut and nozzle body.

8. The fuel injection valve according to claim 1, wherein the sealing element is formed by part of the nozzle clamping nut.

9. The fuel injection valve according to claim 1, wherein the sealing element is formed by part of the combustion chamber seal.

10. An internal combustion engine comprising:

a fuel injection valve;

a nozzle support with a nozzle body disposed thereon in a fixed manner via a nozzle clamping nut;

the nozzle body designed to protrude into the combustion chamber for holding a nozzle needle;

at least one annular combustion chamber sealing element comprising an upper support surface facing the nozzle clamping nut and a lower support surface facing the combustion chamber;

the lower surface surrounding the nozzle body and sealing the nozzle support from the combustion chamber; and at least one additional sealing element for sealing the nozzle body in the area of the nozzle clamping nut;

further comprising the at least one additional sealing element in contact with the upper support surface of the at least one annular combustion chamber sealing element.

11. The internal combustion engine according to claim 10, wherein the sealing element is disposed on at least one of the nozzle clamping nut and the combustion chamber seal.

12. The internal combustion engine according to claim 10, wherein the sealing element is embodied as a separate element.

13. The internal combustion engine according to claim 10, wherein the sealing element is made from very soft metals, heat resistant polymers or other fuel resistant materials.

14. The internal combustion engine according to claim 10, wherein the sealing element is embodied by vulcanizing a seal onto the nozzle clamping nut.

15. The internal combustion engine according to claim 10, wherein the sealing element is embodied by vulcanizing a seal onto the combustion chamber seal.

16. The internal combustion engine according to claim 10, wherein a heat resistant potting compound is provided in a gap region between nozzle clamping nut and nozzle body.

17. The internal combustion engine according to claim 10, wherein the sealing element is formed by part of the nozzle clamping nut.

18. The internal combustion engine according to claim 10, wherein the sealing element is formed by part of the combustion chamber seal.

* * * * *